US006332063B1

(12) United States Patent
Ozawa et al.

(10) Patent No.: US 6,332,063 B1
(45) Date of Patent: Dec. 18, 2001

(54) IMAGE FORMING APPARATUS WITH RESIDUAL TONER DETECTION AND COLLECTION FEATURES

(75) Inventors: Ichiro Ozawa, Funabashi; Masaru Hibino, Minami Ashigara; Masanori Shida, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/536,306

(22) Filed: Mar. 27, 2000

(30) Foreign Application Priority Data

Mar. 31, 1999 (JP) ..... 11-093543

(51) Int. Cl.[7] ..... G03G 15/00

(52) U.S. Cl. ..... 399/27; 399/28; 399/30; 399/58; 399/62; 399/149

(58) Field of Search ..... 399/27, 30, 58, 399/61, 62, 63, 148, 149, 175, 176, 179, 299; 430/56, 57, 83, 45

(56) References Cited

U.S. PATENT DOCUMENTS

| | | | | |
|---|---|---|---|---|
| 5,576,812 | | 11/1996 | Hibino et al. . | |
| 6,049,687 | | 4/2000 | Hibino et al. | 399/270 |
| 6,052,545 | * | 4/2000 | Komiya et al. | 399/61 |
| 6,077,635 | * | 6/2000 | Okado et al. | 430/45 |

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

An image forming apparatus includes a plurality of image forming stations forming images of different colors on a transfer material and is provided along a direction of conveyance of the transfer material by a conveying system, in which a toner replenishing system is operated on the basis of a result of a detected magnetic permeability a detecting device and the developer, which is not transferred to the transfer material but and, which remains on an image bearing member is collected by a developing system.

15 Claims, 8 Drawing Sheets

IMAGE FORMING APPARATUS WITH RESIDUAL TONER DETECTION AND COLLECTION FEATURES

BACKGROUND OF THE INVENTION

1. Field of the Invention

The present invention relates to an image forming apparatus such as a copier, a printer, a recorded image display apparatus or a facsimile apparatus. Particularly it relates to an image forming apparatus in which the toner density of a two-component developer (developing agent) can be properly controlled.

2. Related Background Art (a) Cleanerless Process (Toner Recycle Process)

In recent years, the downsizing of image forming apparatuses has progressed, but even if means and instruments for the image forming processes such as charging, exposing, developing, transferring, fixing and cleaning simply become compact, the general downsizing of the image forming apparatuses has been limited. Also, any untransferred toner on a photosensitive member after transfer is collected by cleaning means (cleaner) and becomes a waste toner, but it is preferable from the viewpoint of the protection of environment that this waste toner does not come out. So, there have appeared image forming apparatuses of the "cleanerless process" designed such that the cleaner is detached and the untransferred toner on the photosensitive member is removed and collected from the photosensitive member by "cleaning simultaneous with developing" by developing means and is recycled. The cleaning simultaneous with developing is a method of collecting the untransferred toner somewhat residual on the photosensitive member after transfer by a fog removing bias (a fog removing potential difference Vback which is the potential difference between a DC voltage applied to developing means and the surface potential of the photosensitive member) during the development after the next step. According to this method, the untransferred toner is collected by the developing means and is recycled after the next step and therefore, the waste toner can be eliminated and maintenance can be made unnecessary. Also, being cleanerless leads to a great advantage in terms of space and can greatly downsize the image forming apparatus.

(b) Developer Density Control

In a developing device provided in an image forming apparatus of the electrophotographic type or the electrostatic recording type, use is often made of a two-component developer having toner particles and carrier particles as chief components. Particularly, in color image forming apparatuses for forming full color images or multicolor images by the electro-photographic process, almost all developing devices use the two-component developer from the viewpoint of the color taste of images. As is well known, the toner density (the rate of the weight of toner particles to the total weight of carrier particles and toner particles) of this two-component developer is a very important factor for stabilizing the quality of image. The toner particles of the developer are consumed during development and the toner density is varied. Therefore, it is necessary to accurately detect the toner density of the developer and operate an automatic toner replenishing device (ATR) in conformity with a variation in the toner density to thereby control the toner density so as to be always constant and maintain the quality of images.

Detecting devices and density control devices of various types for detecting the toner density in the developing device in order to correct the density of the developer in the developing device being varied by development as described above, that is, to control the amount of toner replenished to the developing device, have heretofore been proposed and put into practical use. For example, there is a detecting device disposed in proximity to a developer bearing member or the developer carrying path of a developer container, and utilizing that the toner reflects infrared light and that the reflectance thereof differs due to the differences in the spectral sensitivity and light absorptance thereof for each toner density and each color. FIG. 7 shows an example of such a detecting device. The detecting device 10 is provided with a bidirectionally light emitting LED 10*a,* a light receiving element 10*b* for reference and a light receiving element 10*c* for reflection, and one of infrared lights bidirectionally emitted from the LED 10*a* is applied to the developer carried onto the developer bearing member or the developer in the developer container 1 through transparent acrylic resin 10*d,* and the amount of reflected light of the infrared light reflected by the developer is received by the light receiving element 10*c,* and from the light receiving output thereof, the density of the developer is calculated to thereby control toner replenishment (this device will hereinafter be referred to as the "light reflecting type developer density control device").

Or by an LED (light emitting element) 10*a* similar to that described above, infrared light is applied to a patch image A formed on the image bearing member 1, as shown in FIG. 7, and the amount of reflected light of the infrared light reflected by the patch image is received by the light receiving element 10*c,* and when from the light receiving output thereof, the patch image A is higher than desired density, toner replenishing is stopped, and when the patch image A is lower than the desired density, toner replenishing is started to thereby indirectly control the density of the developer (this device will hereinafter be referred to as the "patch type developer density control device").

FIG. 2 of the accompanying drawings shows a four-color full color image forming apparatus comprised of a plurality of stations of the aforedescribed cleanerless process type (image forming stations) arranged along a transfer material conveying belt (transfer material conveying means). A toner image formed on the photosensitive drum of each station is sequentially transferred onto a transfer material (e.g. paper) conveyed by the transfer material conveying belt. In the image forming apparatus of such a construction, there may sometimes occur the so-called retransfer which is a phenomenon that when the toner transferred onto the transfer material in the preceding station adheres to the photosensitive drum of the next station when it has arrived at the next station.

Specifically, the full color image forming apparatus is usually provided with four stations Pa, Pb, Pc and Pd of yellow (Y), magenta (M), cyan (C) and black (K), and the transfer of toner images to the transfer material P is effected four times for Y, M, C and K, but during the second, i.e., M, transfer in the station Pb, part of the Y toner already transferred onto the transfer material P may sometimes be returned onto the photosensitive drum 1. Likewise, during the third, i.e., C, transfer in the station Pc, the Y toner and the M toner are retransferred, and during the fourth, i.e., K, transfer in the station Pd, the Y toner, the M toner and the C toner are retransferred. That is, in the M, C and K stations Pb, Pc and Pd, the toners of colors originally different from the toners in those stations are retransferred to the photosensitive drums 1.

The retransfer of the Y toner in the station Pb for forming the M toner will hereinafter be described as an example with reference to typical views. As shown in FIGS. 8A and 8B, usually when there is provided a cleaner 11 for removing any untransferred toner on the photosensitive drum 1, even if the Y toner T on the transfer material P borne on a transfer material conveying belt 5 conveyed in the direction of arrow R5 is retransferred onto the photosensitive drum 1 of the station Pb, it is collected by the cleaning blade 11*a* of the cleaner 11 and therefore, thereafter it never happens that a different toner is mixed in a developing device 4 through a developing sleeve 4*a* rotated in the direction of arrow R4. In the case of the cleanerless process, however, the cleaner is absent as shown in FIG. 9A, the Y toner T retransferred to the photosensitive drum 1 as shown in FIG. 9B is collected by the developing device 4 as shown in FIG. 9C. The toner retransferred in this manner may be gradually accumulated in the developing device 4 by image formation being repeated and the color taste of the toner in that developing device 4 may sometimes be changed.

In a system such as the aforedescribed light reflecting type developer density control device or patch type developer density control device wherein developer density control is effected from the optical characteristic of the developer or the toner to the developer of which the color taste has thus been changed, that is, the amount of reflected light relative to light of a certain wavelength has been changed, the amount of reflected light may be varied from the variation in the optical characteristic by the color mixing of the toners and an error may occur to the developer density control in spite of suitable developer density and patch density being actually indicated.

As the result, the image density rise and toner scattering by the excessive replenishing of the toners, or the adherence of the carrier resulting from a reduction in image density and a reduction in developer density by the stoppage of the replenishing of the toners may be sometimes caused.

SUMMARY OF THE INVENTION

It is an object of the present invention to provide an image forming apparatus which can keep a developer at desired density and maintain a high quality of image.

It is also an object of the present invention to provide an image forming apparatus which, even when a toner of a different color is mixed in developing means, can well effect developer density control and accordingly, can keep developer density constant and can always maintain a high quality of image.

It is another object of the present invention to provide an image forming apparatus comprising:

transfer material conveying means for conveying a transfer material; and a plurality of image forming stations for forming images of different colors on the transfer material, the image forming stations being provided along a direction of conveyance of the transfer material by the conveying means, each of the image forming stations having:

an image bearing member for bearing a latent image thereon;

developing means for developing the latent image formed on the image bearing member by a developer having a toner and a carrier;

magnetic permeability detecting means for detecting an apparent magnetic permeability of the developer in the developing means;

toner replenishing means for replenishing to the developing means with the toner, the toner replenishing means being operated on the basis of a detection result of the magnetic permeability detecting means; and transfer means for transferring a developer image on the image bearing member to the transfer material, developer not transferred to the transfer material but remaining on the image bearing member being collected by the developing means.

Other objects and features of the present invention will become more fully apparent from the following detailed description when read with reference to the accompanying drawings.

DESCRIPTION OF THE PREFERRED EMBODIMENTS

Some embodiments of the present invention will hereinafter be described with reference to the drawings.

Embodiment 1

Figure 1:
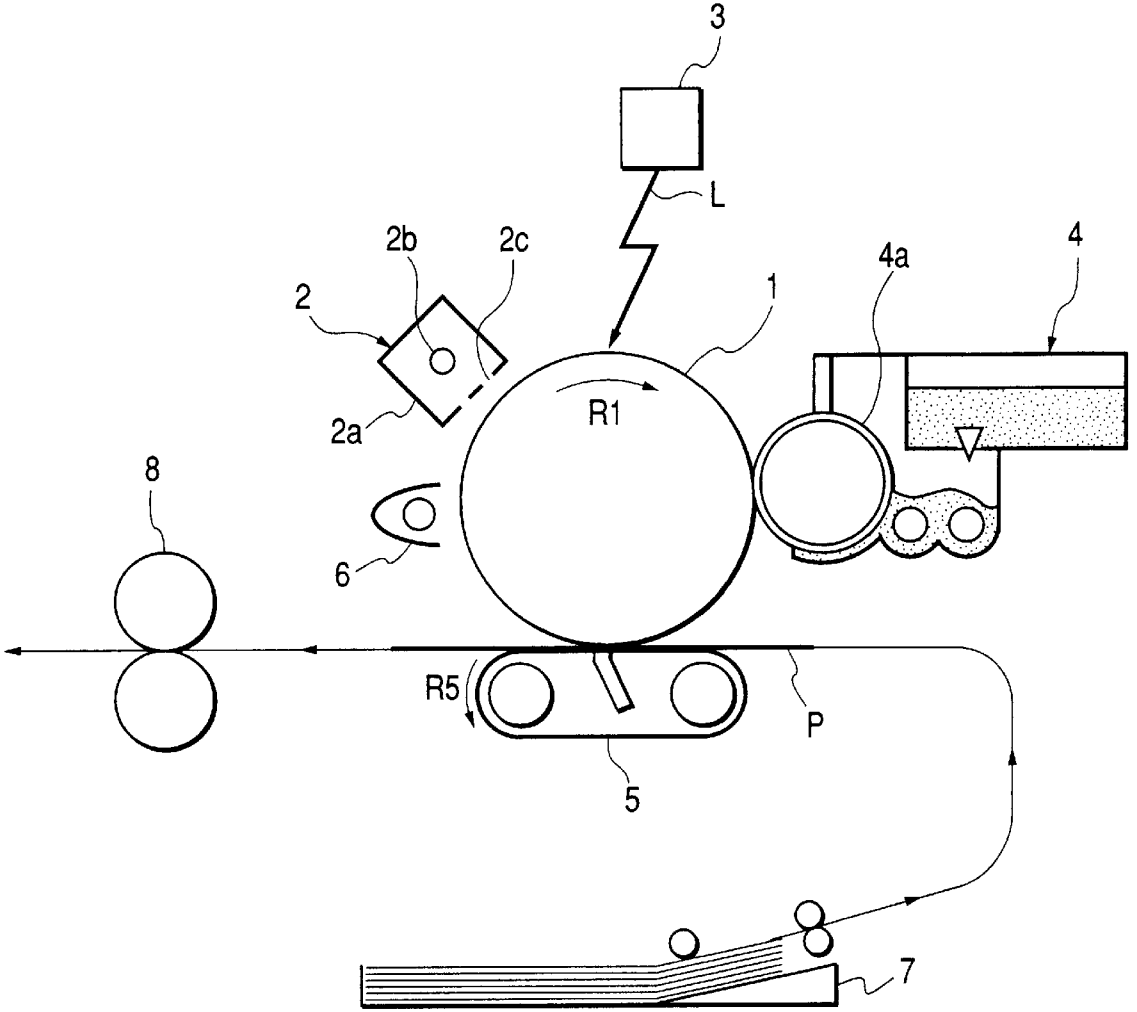
FIG. 1 is a longitudinal cross-sectional view illustrating one image forming station in an embodiment of the present invention.

FIG. 1 shows an image forming apparatus according to the present embodiment. FIG. 1 is a longitudinal cross-sectional view schematically showing the construction of an image forming apparatus of the electro-photographic type. In FIG. 1, there is shown only one of four stations (image forming stations).

The image forming apparatus shown in FIG. 1 is provided with a drum type electrophotographic photosensitive member (hereinafter referred to as the "photosensitive drums") 1 as an image bearing member. The photosensitive drum 1 is supported for rotation in the direction of arrow R1. A primary charger (charging means) 2, an exposing device 3, a developing device (developing means) 4, a transfer charger 9 and a pre-exposing device 6 are provided substantially in the named order around the photosensitive drum 1 along the direction of rotation thereof. The image forming apparatus is also provided with a sheet feeding cassette 7, a transfer material conveying belt (transfer material conveying means) 5 and a fixing device 8.

In this image forming apparatus, the surface of the photosensitive drum 1 is first uniformly charged by the primary charger 2. The photosensitive drum 1 is rotatively driven in the direction of arrow R1 at a process speed (peripheral speed) of 150 mm/sec.

Figure 2:
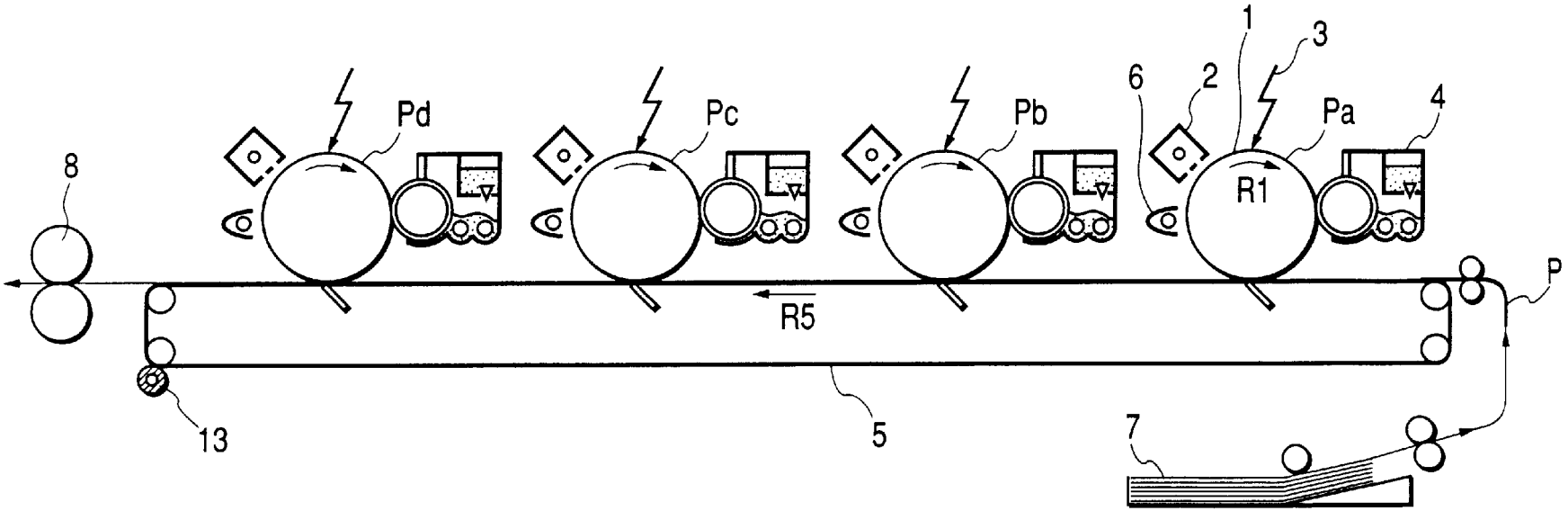
FIG. 2 is a longitudinal cross-sectional view schematically showing the construction of an image forming apparatus having a plurality of image forming stations according to Embodiment 1 of the present invention.

Next, scanning exposure is effected by a laser beam L from the exposing device 3 modulated by an image signal, whereby a latent image is formed on the photosensitive drum 1. This latent image is reversal-developed by the developing device 4. In the present embodiment, in order to realize full color, four stations as shown in FIG. 1, i.e., a first station Pa for yellow, a second station Pb for magenta, a third station Pc for cyan and a fourth station Pd for black, are arranged in the named order from the upstream side with respect to the direction of movement of the transfer material conveying belt 5 (the direction of arrow R5), as shown in FIG. 2, and the image forming processes of the aforedescribed charging, exposing and developing are carried out for the four colors Y, M, C and K, whereby a full color image can be obtained. In FIG. 2, the reference numeral 13 designates a cleaning roller for cleaning the transfer material conveying belt 5.

The toner image on the photosensitive drum 1 is transferred to a transfer material P taken out of the sheet feeding cassette 7 and conveyed via a sheet feeding roller and a sheet feeding guide (not shown), by the transfer charger 9. Any toner not transferred but remaining on the surface of the photosensitive drum 1 (transfer residual toner) is thereafter collected in the developing device 4 by a fog removing bias, and is again used for development. Thereafter, the photosensitive drum 1 has its charges removed by the pre-exposing device 6 and is used for the next image formation.

On the other hand, the transfer material P to which the toner images of the four colors Y, M, C and K have been successively transferred is conveyed to the fixing device 8 by the transfer material conveying belt 5 and is heated and pressed, whereby the toner images are fixed on the surface of the transfer material P.

(a) Photosensitive Drum (Image Bearing Member)

The photosensitive drum 1 used in the present embodiment is an OPC (organic photoconductor) photosensitive member of negative charging characteristic formed into a drum-like shape, and comprises a drum base of aluminum having a diameter of 30 mm and a photosensitive layer of OPC provided thereon so as to cover the surface thereof. The photosensitive member usable in the present embodiment is not limited to that described above, but may be, for example, an amorphous silicon photosensitive member or a selenium photosensitive member by suitably choosing a developer, and the charging characteristic of the photosensitive member may be positive or negative. Also, the shape of the photosensitive member need not always be a drum-like shape, but a belt-like shape can also be chosen.

(b) Primary Charger (Primary Charging Means)

The primary charger 2 used in the present embodiment is a corona charger having a shield 2*a* having its portion opposed to the photosensitive drum 1 opened, a discharge wire 2*b* disposed inside the shield 2*a* in parallel with the generatrix of the photosensitive drum 1, and a grid 2*c* disposed in the opening portion of the shield 2*a* for regulating the charging potential.

(c) Developing Device (Developing Means)

The developing device 4 used in the present embodiment will now be described with reference to FIG. 3.

The developing device 4 is disposed in opposed relationship with the photosensitive drum 1, and the interior thereof is comparted into a first chamber (developing chamber) 4*d* and a second chamber (agitating chamber) 4*f* by a vertically extending partition wall 4*c*. A non-magnetic developing sleeve (developer bearing member) 4*a* rotated in the direction of arrow R4 is disposed in the first chamber 4*d*, and a magnet 4*b* is fixedly disposed in this developing sleeve 4*a*. The developing sleeve 4*a* bears and carries on the surface thereof a layer of a two-component developer (including carrier particles and toner particles) having its layer thickness regulated by a blade 4*i*, and causes the toner to adhere to the electrostatic latent image on the photosensitive drum 1 in a developing area opposed to the photosensitive drum 1, thereby developing the latent image as a toner image. In order to improve developing efficiency, i.e., the rate at which the toner is imparted to the electrostatic latent image, a developing bias voltage comprising a DC voltage superimposed on an AC voltage is applied from a developing bias voltage source 4*j* to the developing sleeve 4*a*.

Developer agitating screws 4*g* and 4*h* are disposed in the first chamber 4*d* and the second chamber 4*f*, respectively. The screw 4*g* agitates and carries the developer in the first chamber 4*d*, and the screw 4*h* agitates and carries the toner supplied from the toner discharge port 12*a* of the toner replenishing tank 12*c* of toner replenishing means 12 by the rotation of a carrying screw 12*b* and the developer D already contained in the developing device, thereby uniformalizing the toner density. Developer paths (not shown) for communicating the first chamber 4*d* and the second chamber 4*f* with each other are formed in the end portions of the partition wall 4*c* on this side and the inner side (that side) thereof, and by the carrying forces of the screws 4*g* and 4*h*, the developer in the first chamber 4*d* of which the toner has been consumed by development and the toner density has been reduced is moved from one of the paths into the second chamber 4*f*, and the developer of which the toner density has been recovered in the second chamber 4*f* is moved from the other path into the first chamber 4*d*.

(d) Developer Density Control Device (Control Means)

Figure 3:
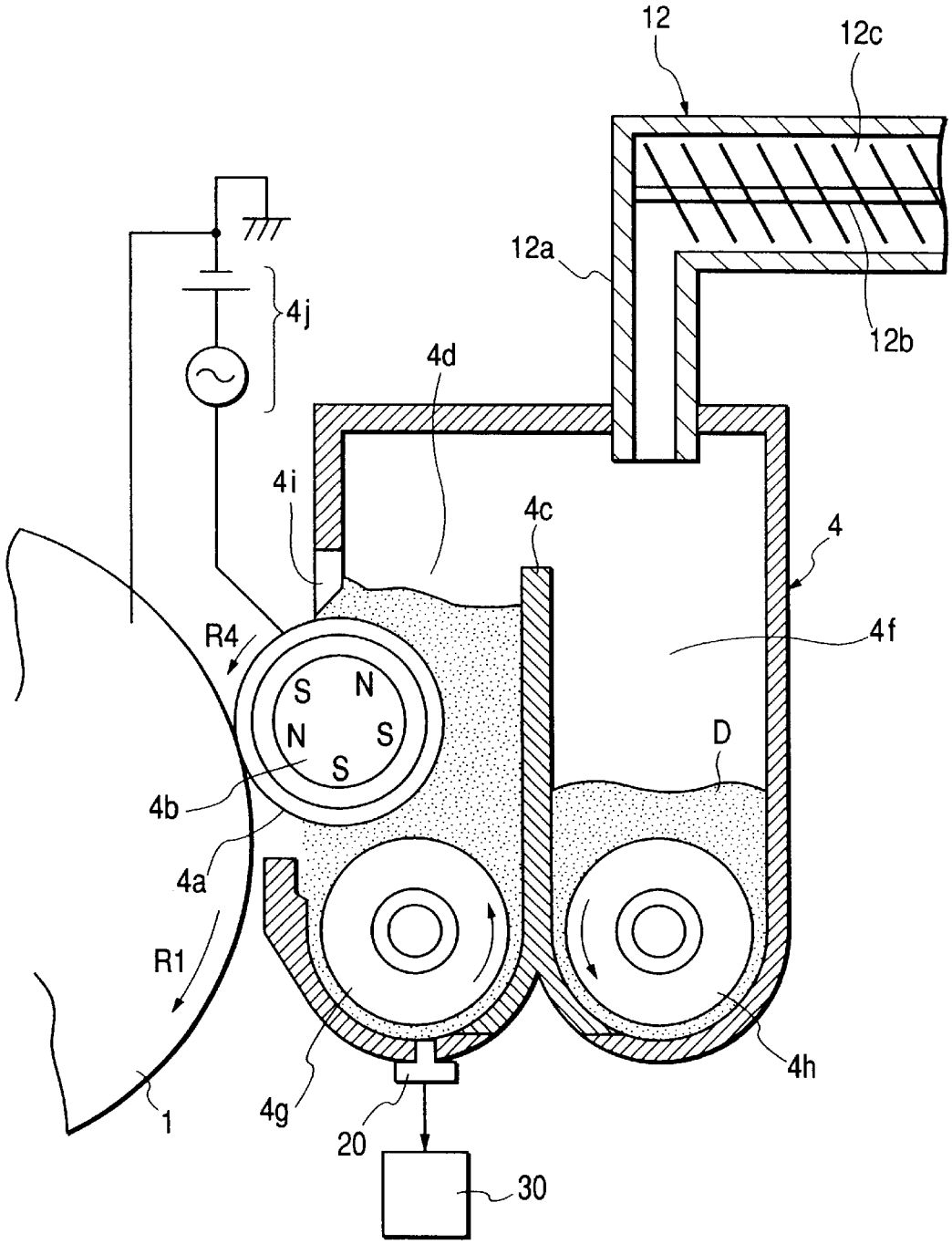
FIG. 3 is a longitudinal cross-sectional view showing the construction of a developing device in Embodiment 1.

In the present embodiment, in order to correct the density of the developer in the developing device 4 shown in FIG. 3 being changed by the development of the electrostatic latent image, that is, in order to control the amount of toner replenished to the developing device 4, there is adopted not optical developer density detection, but the so-called inductance detection system (ATR) in which the apparent magnetic permeability of the two-component developer is detected and from the result of the comparison between a detection signal based on the result of this detection and the reference value of the detection signal, the control of toner replenishing is effected. This is such that an inductance head (magnetic permeability detecting means) 20 is installed on the bottom wall of the first chamber 4*d* of the developing device 4 and the actual toner density of the developer D in the developing device 4, and more specifically, in the first chamber 4*d*, is detected by a detection signal from this inductance head 20, and is compared with a reference value by a developer density control device (control means) 30 and further, depending on the result of the comparison, the toner replenishing means 12 is driven to thereby replenish the toner to the developing device 4.

Figure 4:
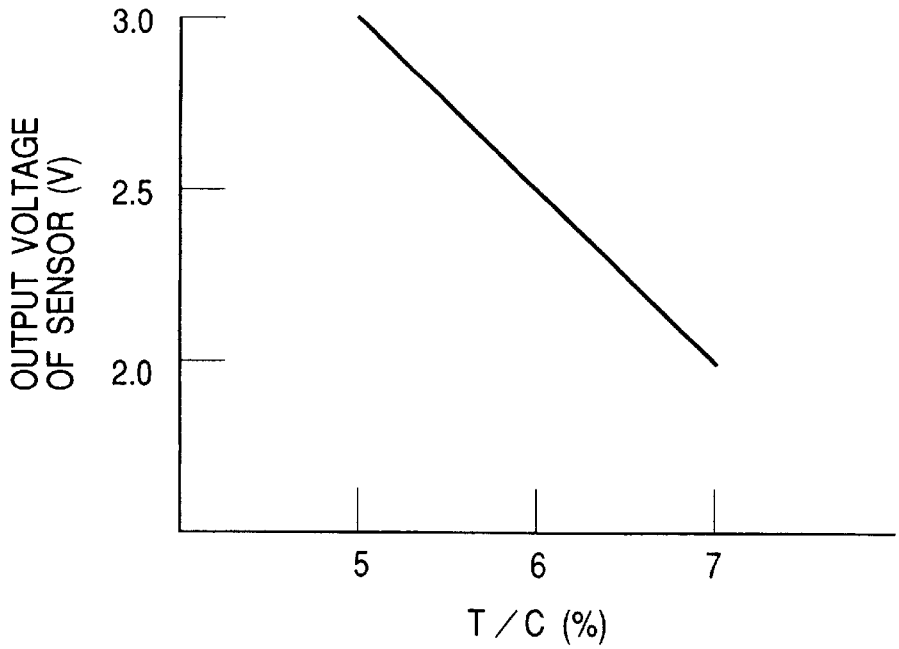
FIG. 4 is a characteristic graph showing the manner in which a detection signal from an inductance head is varied by a variation in the toner density of a developer.

More particularly, when the toner density (the rate of the weight of toner particles to the total weight of carrier particles and toner particles) of the developer D shown in FIG. 3 is changed, the apparent magnetic permeability by the mix percentage of magnetic carrier and non-magnetic toner is changed. This apparent magnetic permeability is detected by the inductance head 20 and is converted into an electrical signal, whereupon as shown in FIG. 4, this electric signal substantially linearly changes in conformity with the toner density. That is, the output electrical signal from the inductance head 20 corresponds to the actual toner density of the two-component developer in the developing device 4. The axis of abscissas of FIG. 4 represents the T/C ratio (the weight ratio (%) of the toner T to the carrier C) of the developer D, and the axis of ordinates represents the output voltage of the sensor.

The image forming apparatus of the above-described construction according to the present embodiment adopts the cleanerless process, and any toner residual on the photosensitive drum 1 after the transfer of the toner image to the transfer material P (untransferred toner (transfer residual toner)) comes to the developing device, and is collected by cleaning simultaneous with developing with the aid of a fog removing electric field during development. Thereby the untransferred toner is recycled in the developing device 4 and is also used after the next step and therefore, waste toner can be eliminated. Also, the advantage in terms of space is great, and the great downsizing of the image forming apparatus has become possible.

However, in the image forming apparatus according to the present embodiment for forming a color image by a plurality of stations adopting the cleanerless process, the color taste of the developers has been changed by the mixing of retransferred toners of different colors.

Specifically, image formation was effected 50,000 times, whereafter the magenta developer in the second station from the upstream side along the direction of movement of the transfer material conveying belt 5 was put into a water solution containing a surfactant and the toner only was separated therefrom, and it was observed by means of an optical microscope of high magnification. As the result, the yellow toner used in the first station was mixed by about 10% by retransfer.

In the present embodiment, however, even if the retransferred Y toner was mixed with the station for magenta by about 10% as previously described, finally the initial toner density 6% could be substantially maintained.

By thus using the inductance detecting sensor for examining the magnetic characteristic of the developers, it has become possible to effect the density control of the developers accurately even if there is a fluctuation in the color taste of the developers.

Comparative Example 1

In contrast with the above-described Embodiment 1, image formation was effected 50,000 times by the use of a light reflecting type developer density control device. As the result, retransferred Y toner was mixed by 10% with the developer in the magenta developing device 4 in the second station, and the final toner density greatly deviated from an initial value 6% to 7%.

Figure 5:
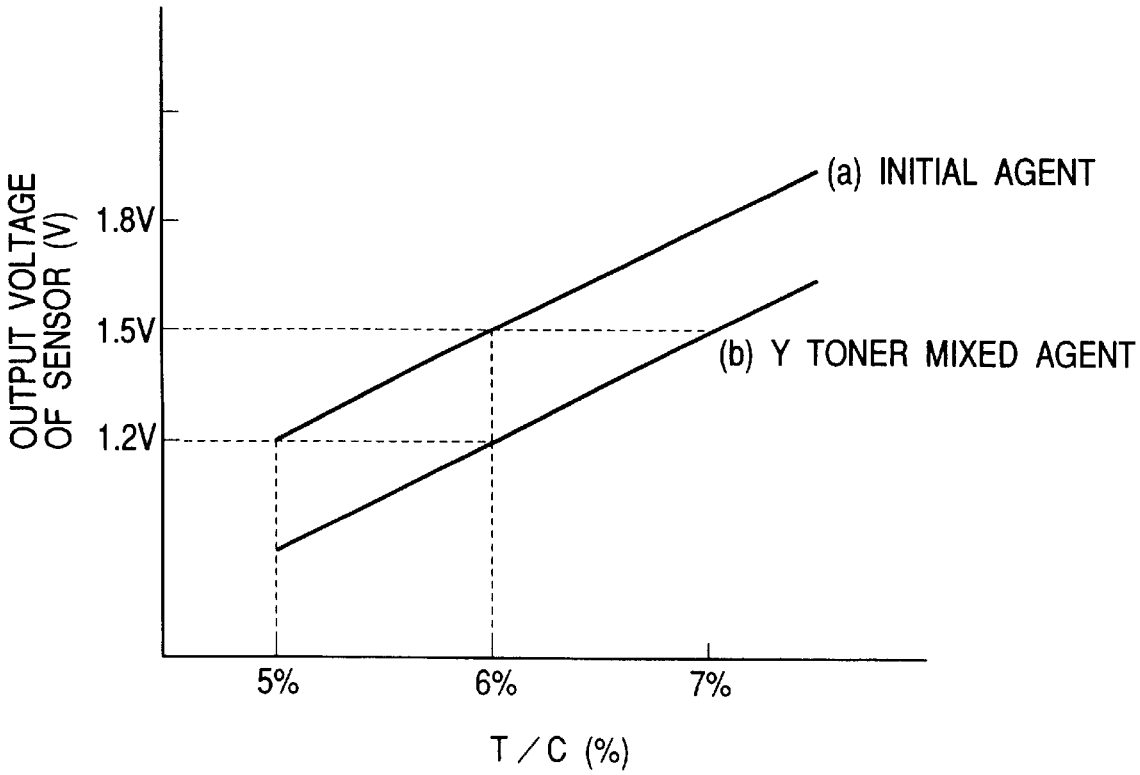
FIG. 5 is a characteristic graph showing the manner in which a detection signal from a light reflecting type sensor is varied by a variation in the toner density of the developer.

This can be explained as follows. The light reflecting type sensor used in this comparative example is set so that as indicated by (a) in FIG. 5, the output voltage by the reflected light from the magenta developer of the initial toner density 6% may be 1.5 V, and on the basis of it, the toner replenishing control thereafter is effected. However, according to our investigation, when the magenta toner and the yellow toner were mixed together at a ratio of 9:1 (that is, a state in which the yellow toner is mixed by 10% with the magenta toner) and on the basis of it, a developer of 6% was prepared, the output of the sensor came down to 1.2 V as indicated by (b) in FIG. 5. Accordingly, in such a developer, the sensor recognizes that as indicated by (a) in FIG. 5, the density of the developer is 5% and therefore, when toner supply control is done so that the output may become 1.5 V, the toner is excessively replenished until finally the toner density rises by 1%. As the result, when retransferred Y toner is mixed by 10%, the toner density in the station for magenta is considered to have become 7%.

Embodiment 2

Toner particles used in this embodiment are a spherical polymerized toner and a method of manufacturing it is such that in the present embodiment, a monomer composition comprising a colorant and a charge controlling agent added to the monomer of the polymerizing method was suspended and polymerized in a water medium to thereby obtain spherical toner particles. The producing method is not limited to the above-described method, but the toner may be produced by the emulsion polymerizing method or the like, and other additives may be included. The spherical polymerized toner provided by these manufacturing methods is such that the shape factor SF1 is 100 to 140 and the shape factor SF2 is 100 to 120. In the present invention, values obtained by sampling 100 toners at random by the use of FE-SEM (S-800) produced by Hitachi Works Ltd., introducing the image information thereof into an image analyzing apparatus (Lusex 3) produced by Nicolet Japan Corporation through an interface to thereby effect analysis, and calculating from the following expressions are defined as the shape factors SF1 and SF2.

$$SF1=\{(MXLNG)^2/(AREA)\}\times(100\pi/4)$$

$$SF2=((PERI)^2/(AREA))\times(100/4\pi),$$

where

AREA: toner projection area

MXLNG: absolute maximum length

PERI: peripheral length.

The shape factor SF1 indicates the degree of sphericity, and as it becomes greater, the shape gradually changes from sphericity to amorphism. On the other hand, the shape factor SF2 indicates the degree of unevenness, and as it becomes greater, the unevenness of the surface becomes remarkable.

In contrast with the shape factors (SF1=100 to 140, SF2=100 to 120) of the spherical polymerized toner in the present embodiment, the shape factors of the crushed toner in the prior art is such that SF1 is 180 to 220 and SF2 is 180 to 200 and therefore, it will be seen that as compared with the crushed toner in the prior art, the spherical polymerized toner is approximately round in the shape of toner particles. This spherical polymerized toner, as compared with the crushed toner in the prior art, is small in the rate of change in the shape factors of toner particles relative to the deterioration of the developer, and in the crushed toner, the changes in the shape factors resulting from the agitation of the developer and the compression of the developer occurring when the developing device is operated for 5 hours become approximate to sphericity such that SF1 is 120 to 150 and SF2 is 120 to 140, whereas in the spherical polymerized toner, there is little or no change in the shape such that SF1 is 100 to 120 and SF2 is 100 to 120. This shows that the crushed toner suffers a great change in shape because it approximates to sphericity with its uneven surface layer scraped off by the friction by its contact with the carrier due to agitation or the contact among toner particles, whereas the spherical polymerized toner which originally is approximately round, as compared with the crushed toner, has a small factor for a change in shape. From what has been described above, the crushed toner suffers a great change in the shape of toner particles and consequently, is also great in the rate of change in the contact area between the developers and is also great in the change in percentage of void and bulk density. In contrast, in the spherical polymerized toner, as described above, the change in the shape of toner particles is small and therefore, the change in bulk density is also small, and the more accurate developer density control by the inductance detecting sensor has become possible.

Embodiment 3

The feature of this embodiment is that by changing the material and property of the carrier, the change in the amount of charging of the toner is suppressed. Specifically, by using a high-resistance carrier, it has become possible to suppress the change in the amount of charging of the toner.

We have considered the cause of such a difference as follows. The high-resistance carrier in the present embodiment and the conventional ferrite magnetic carrier differ in specific resistance from each other, and the ferrite carrier is as low as $1\times10^{9}$ to $1\times10^{10}$ Ω·cm in its own resistance, whereas the high-resistance carrier is as high as $1\times10^{10}$ to $1\times10^{14}$ Ω·cm in its own resistance and therefore, charges are difficult to accumulate in the carrier and it is difficult for charges once accumulated in the carrier to escape and thus, it is considered that the rise of the amount of charging of the toner when the image forming operation was continuously performed and the reduction in the amount of charging of the toner when image formation was not done and the developer was left for a long period of time as it was were suppressed. Accordingly, the more accurate developer density control by the inductance detecting sensor in which the change in bulk density resulting from the change in the amount of charging is small has become possible.

We produced the above-described high-resistance carrier by polymerizing binder resin and a resin magnetic carrier comprising a magnetic metal oxide and a non-magnetic metal oxide, but use may also be made of a carrier of which the resistance was adjusted by other manufacturing method.

Embodiment 4

The feature of this embodiment is that the magnetized amount of the carrier is reduced to thereby reduce the compression of the developer and suppress the deterioration of the developer and a change in the amount of charging. Specifically, by using a low-magnetization carrier, it has become possible to suppress the deterioration of the developer and the change in the amount of charging of the toner. Accordingly, the change in bulk density resulting from the deterioration of the developer and the change in the amount of charging is small, and the more accurate developer density control by the inductance detecting sensor has become possible.

The intensity (1000 oersted ($1000\times1000/4\pi=10^{6}/4\pi$A/m)) of the magnetization of the carrier particles used in the present embodiment is 135 emu/cm$^3$ ($135\times4\pi\times10^{-4}=5.4\pi\times10^{-2}$ Wb/m$^2$, and the measurement of the magnetization was done by the use of a vibration magnetic field type magnetic characteristic automatic recording apparatus BHV-30 produced by Riken Denshi Co., Ltd. As regards the magnetic characteristic value of the carrier powder, an external magnetic field of 1 kilooersted ($10^{6}/4\pi$A/m) is made and the intensity of the then magnetization is found. The carrier is made in a state in which it is packed in a cylindrical plastic container so as to become sufficiently dense. In this state, the magnetization moment is measured and the actual weight when a sample has been put in is measured, whereby the intensity (emu/g (Wb·m/k8)) of the magnetization is found. The true specific gravity of the carrier particle is then found by a dry type automatic density meter Acubic 1330 (produced by Shimazu Works Ltd.), and the intensity (emu/g (Wb·m/kg)) of the magnetization is multiplied by the true specific gravity, whereby the intensity (emu/cm$^3$ (Wb/m$^2$)) of magnetization per unit volume of the present invention was found. Good density control was possible within a range of 30 (emu/cm$^3$ ($30\times4\pi\times10^{-4}=1.2\pi\times10^{-2}$ Wb/m$^2$) to 200 emu/cm$^3$ ($200\times4\pi\times10^{-4}=8\pi\times10^{-2}$ Wb/m$^2$) of the intensity (1000 oersted) of the magnetization.

Embodiment 5

Figure 6:
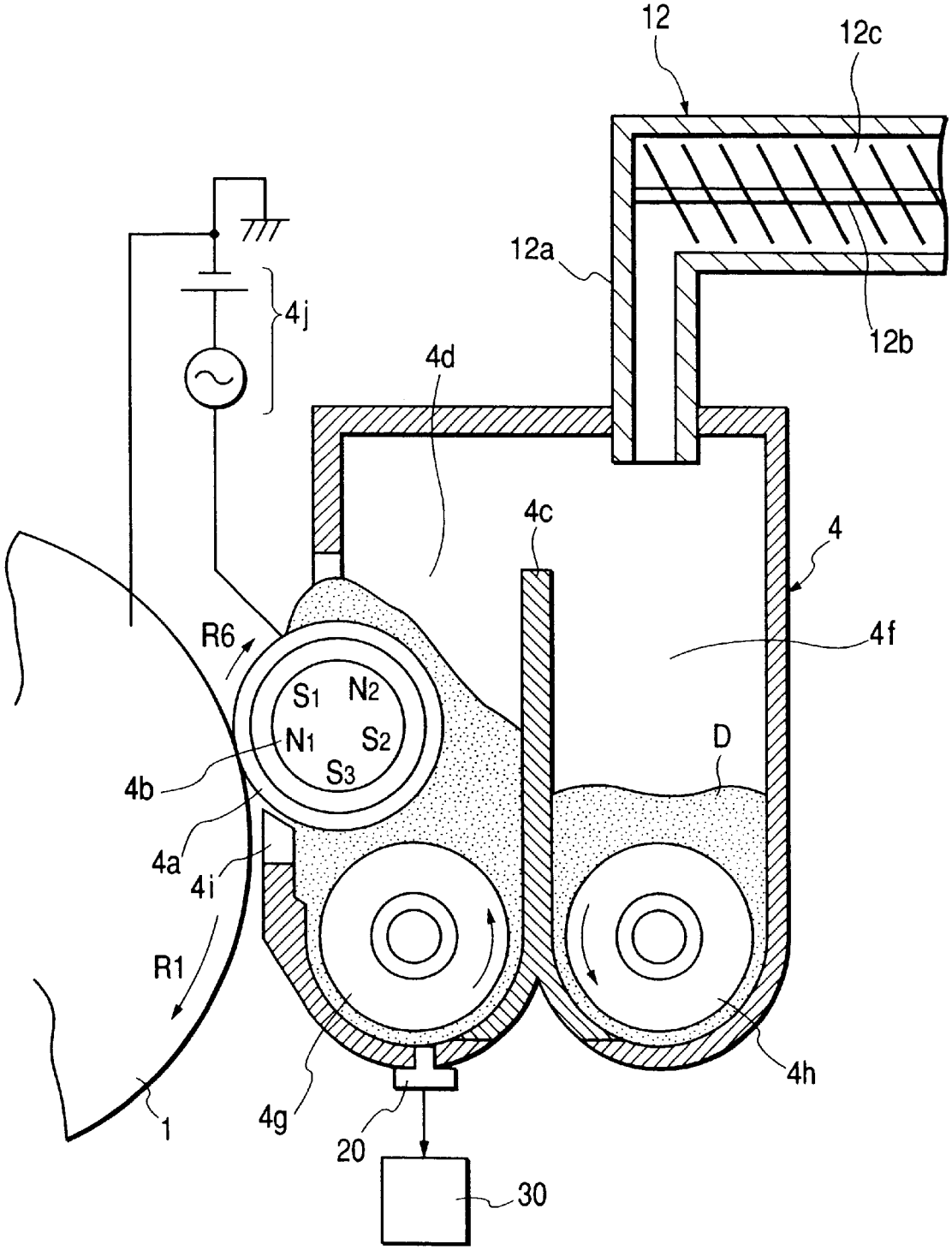
FIG. 6 is a longitudinal cross-sectional view schematically showing the construction of a developing device in Embodiment 5 of the present invention.
Figure 7:
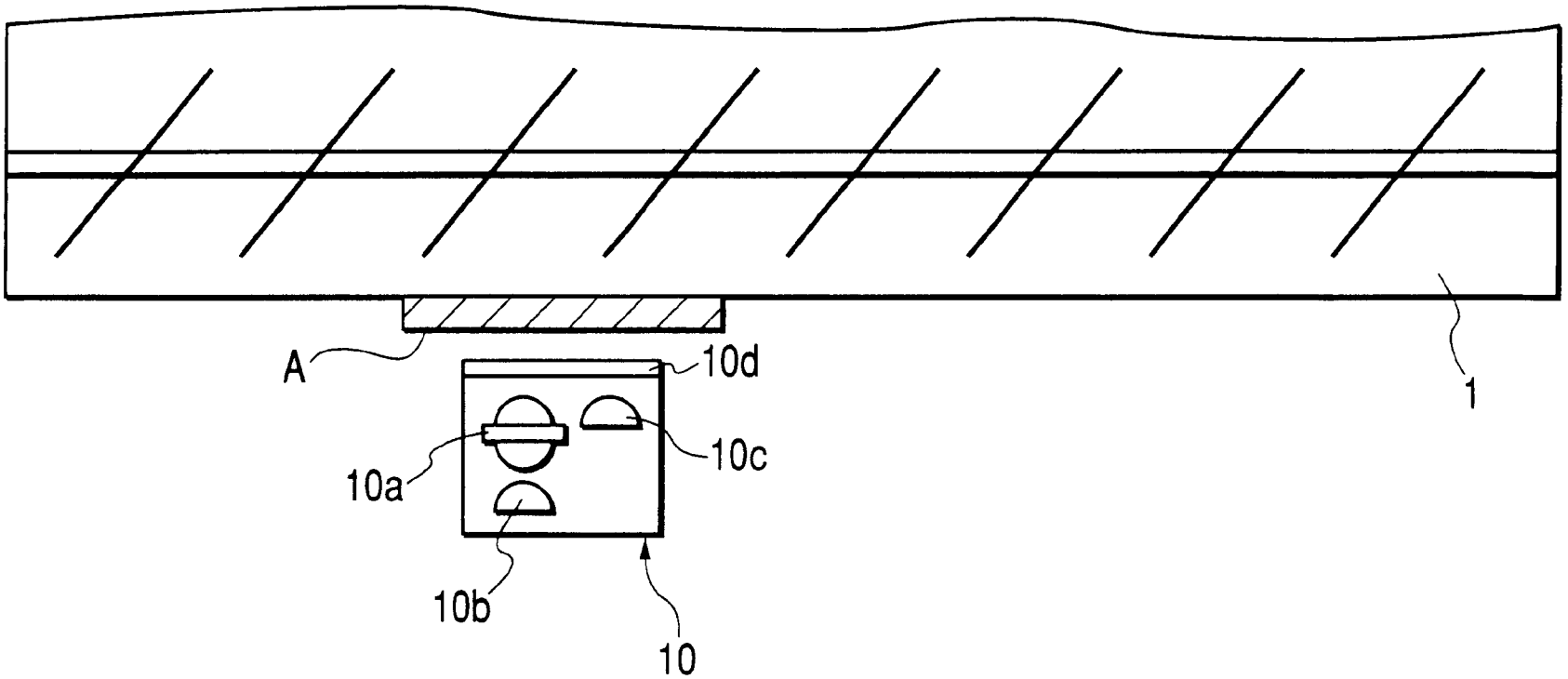
FIG. 7 is a typical view showing an example of a light reflecting type sensor for optically detecting the density of the developer.
Figure 8A:
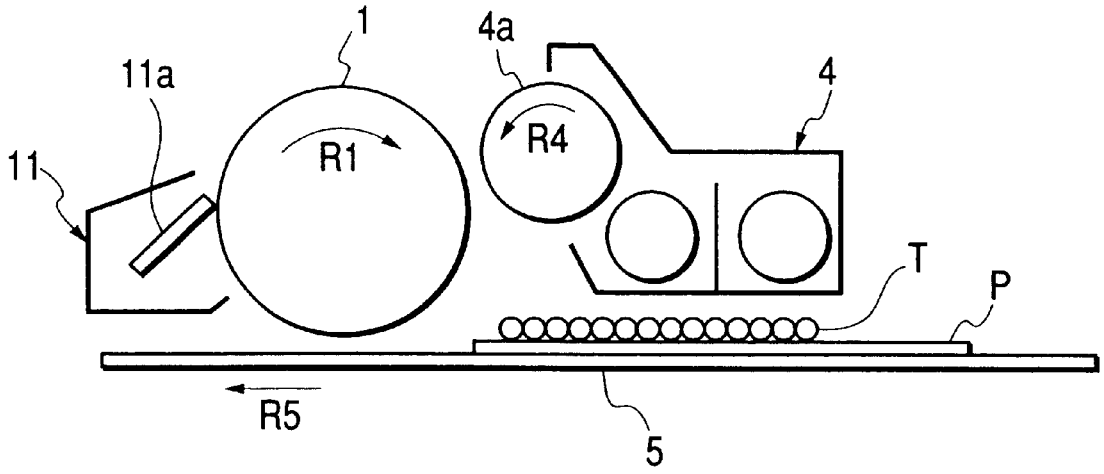
FIGS. 8A and 8B illustrate a method of collecting retransferred toner in a construction having a cleaner.
Figure 8B:
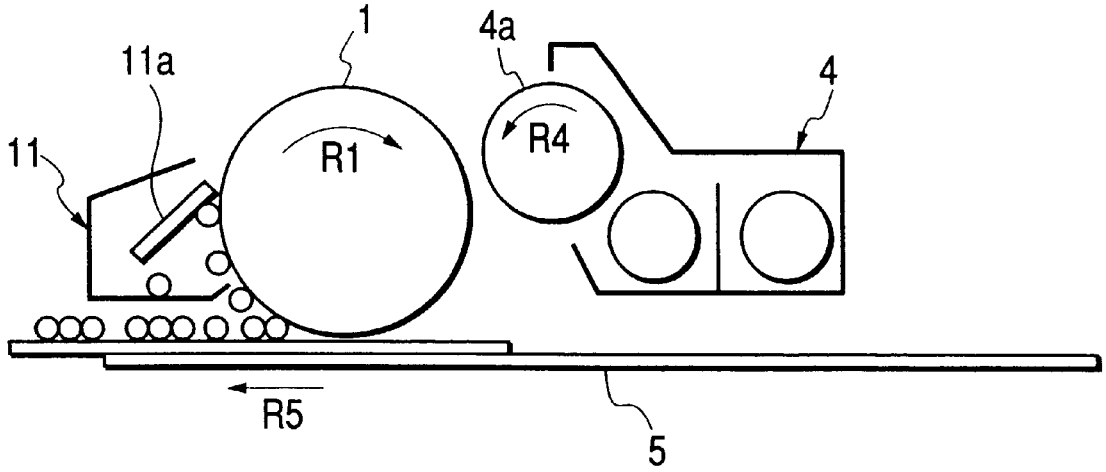
Figure 9A:
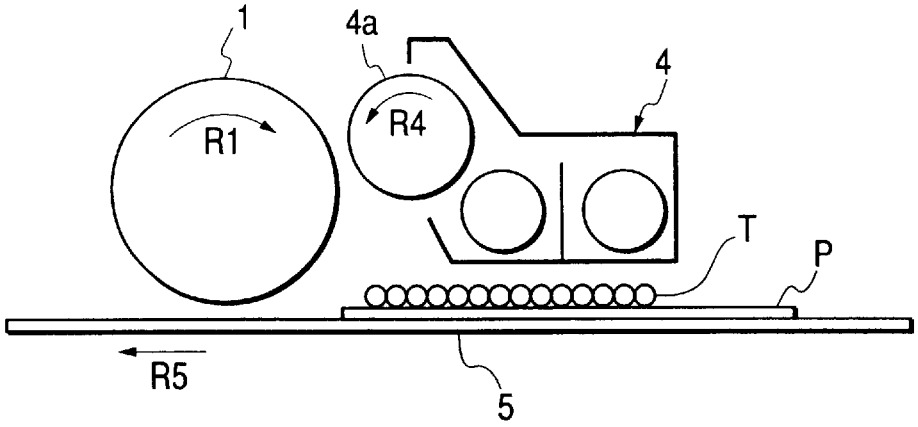
FIGS. 9A, 9B and 9C illustrate a method of collecting retransferred toner in a cleanerless process.
Figure 9B:
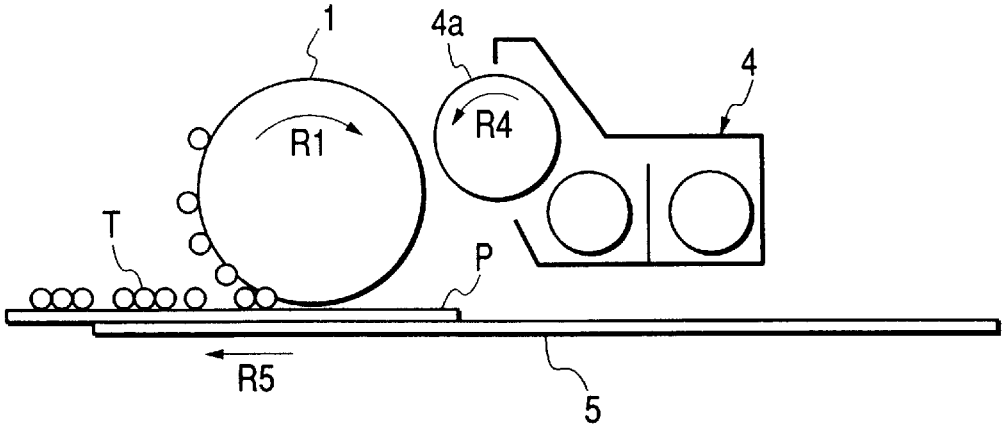
Figure 9C:
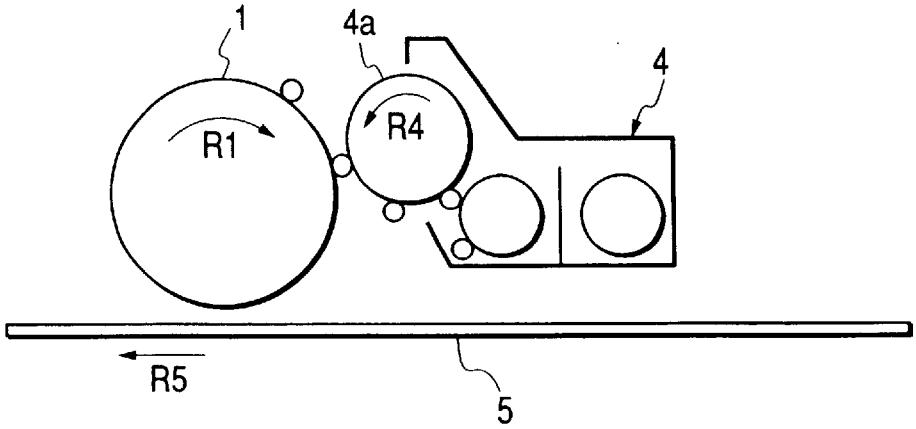

The feature of the construction of this embodiment is that the developing sleeve 4*a* of the developing device 4 is rotated so that in the opposed portion thereof to the photosensitive drum 1, the direction of movement of the surface thereof may be a counter direction to the direction of movement of the surface of the photosensitive drum. According to our investigation, as shown in FIG. 6, the developing sleeve 4*a* is rotated so that the direction of movement (the direction of arrow R4) of the surface of the developing sleeve 4*a* may be opposite to the direction of movement (the direction of arrow R1) of the surface of the photosensitive drum 1. In this construction, the developer D in the developing chamber 4*d* is dipped up by the use of the pole $S_2$ of the magnet roller 4*b* and the developer D is applied to the surface of the developing sleeve 4*a,* whereafter the total pressure of the applied developer D is regulated by the regulating blade 4*i,* whereby the amount of coat of the developer D on the surface of the developing sleeve 4*a* is controlled. Therefore, in the construction of FIG. 3, i.e., the construction in which the directions of movement of the surface of the photosensitive drum 1 and the surface of the developing sleeve 4*a* are the same, the developer clogs near the regulating blade 4*i* of the developing sleeve 4*a,* whereas in the construction of FIG. 6, the compressibility of the developer near the regulating blade 4*i* of the developing sleeve 4*a* is small and as the result, the deterioration of the developer can be prevented, and it has become possible to suppress the fluctuation in the amount of charges of the toner. This leads to the capability of suppressing the change in the bulk density of the developer by a change in the shape of the toner or the change in the charging amount of the toner resulting from the compression of the developer, and decreasing the change in the bulk density by the repulsion between the developers. According to the present embodiment, the deterioration of the developer and the fluctuation in the bulk density by a change in the charging amount are small relative to the conventional system in which the surface of the developing sleeve is moved in a forward direction relative to the surface of the photosensitive drum 1, and the more accurate developer density control by the inductance detecting sensor has become possible.

As described above, according to the present embodiment, in an image forming apparatus wherein a plurality of image forming stations are disposed along the direction of movement of transfer material conveying means, and toner images of different colors formed on the image bearing members of the respective image forming stations are successively transferred onto a transfer material borne and conveyed by the transfer material conveying means, when the untransferred toner on the image bearing member is collected by the developing means of each image forming station, even if a toner of a different color is mixed in the developing means, the apparent magnetic permeability of the developer in the developing means is detected and on the basis of the result of the detection, the toner is replenished to the developing means and therefore, developer density control can be effected well and accordingly, the developer density can be kept constant and a high quality of image can always be maintained.

What is claimed is:

1. An image forming apparatus comprising:

a plurality of image bearing members;

a plurality of image forming means for forming images having colors different from each other on each of said image bearing members, wherein each of said image forming means includes developing means for developing an electrostatic image formed on said image bearing member with a developer including a toner and carrier, and wherein toner remaining on each of said image bearing members is collected in a corresponding one of said developing means after the image on each of said image bearing member is transferred on a common recording material, a plurality of detecting means for detecting information corresponding to a density of the developer in each of said developing means; and control means for controlling an amount of the developer with which each of said developing means is replenished according to an output of each of said detecting means, wherein each of said detecting means detects information corresponding to a permeability of the developer.

2. An image forming apparatus according to claim 1, wherein a shape factor SF1 of the toner is in the range of 100 to 140, and a shape factor SF2 of the toner is in the range of 100 to 120.

3. An image forming apparatus according to claim 2, wherein said toner is produced by a polymerizing method.

4. An image forming apparatus according to claim 1, wherein a volume resistance value of said carrier is in the range of $1\times10^{10}$ to $1\times10^{14}$ Ω·cm.

5. An image forming apparatus according to claim 4, wherein the magnetized amount of said carrier in a magnetic field of 1000 oersted is in the range of 30 to 200 emu/cm$^3$.

6. An image forming apparatus according to claim 1, wherein said developing means includes a developer bearing member bearing and carrying the developer thereon, and a moving direction of said developer bearing member and a moving direction of said image bearing member are opposite to each other in an opposed portion of said developer bearing member and image bearing member.

7. An image forming apparatus according to claim 6, wherein said developing means includes a layer thickness regulating member for regulating a layer thickness of the developer borne on said developer bearing member, and said layer thickness regulating member is provided below said developer bearing member.

8. An image forming apparatus according to claim 1, wherein said developing means includes a developer bearing and carrying the developer thereon, and a voltage comprising an AC voltage superimposed on a DC voltage is applied to said developer bearing member.

9. An image forming apparatus according to claim 1, wherein each of said developing means includes a developer bearing member for bearing and carrying the developer to a developing portion, and a magnetic field generating means for generating a magnetic field in each of said developer bearing members.

10. An image forming apparatus according to claim 9, wherein said magnetic field generating means has a first magnetic pole, and a second magnetic pole that is provided to be adjacent to a downstream side of said first magnetic pole in a moving direction of said developer bearing member and has a polarity, which is the same as a polarity of said first magnetic pole.

11. An image forming apparatus according to claim 10, further comprising a regulating member for regulating a layer thickness of the developer borne on said developer bearing member, wherein, in the moving direction of said developer bearing member, said regulating member is provided at a downstream side of a position where the developer is supplied to said developer bearing member by said second magnetic pole and at an upstream side of said developing portion.

12. An image forming apparatus according to claim 11, wherein said regulating member is provided below said developer bearing member.

13. An image forming apparatus according to claim 11, wherein said magnetic field generating means is provided proximate to said developing portion and has a third magnetic pole having a polarity opposite to the polarity of said second magnetic pole.

14. An image forming apparatus according to claim 9, wherein said magnetic field generating means is fixedly disposed in said developer bearing member.

15. An image forming apparatus according to any one of claims 9 to 14, wherein, in said developing portion, the moving direction of said developer bearing member is opposite to the moving direction of said image bearing member.

* * * * *